United States Patent [19]

Dubbelday et al.

[11] 4,361,879

[45] Nov. 30, 1982

[54] FERROFLUID TRANSDUCER

[75] Inventors: Pieter S. Dubbelday, Merritt Island; Robert W. Timme, Orlando, both of Fla.

[73] Assignee: The United States of America as represented by the Secretary of the Navy, Washington, D.C.

[21] Appl. No.: 180,547

[22] Filed: Aug. 25, 1980

[51] Int. Cl.[3] ..... H04R 15/00

[52] U.S. Cl. ..... 367/141; 367/168; 310/26

[58] Field of Search ..... 367/141, 156, 168, 166, 367/171; 310/26

[56] References Cited

U.S. PATENT DOCUMENTS

| | | | |
|---|---|---|---|
| 3,009,131 | 11/1961 | Woodworth | 367/168 X |
| 3,406,302 | 10/1968 | Lanyi et al. | 367/168 X |
| 4,223,401 | 9/1980 | Parrssinen | 367/168 |
| 4,308,603 | 12/1981 | Overby | 367/141 |

OTHER PUBLICATIONS

"Application Of Ferrofluids As An Acoustic Transducer Material" by Dubbelday NRL Report 4030, Dec. 4, 1979.

*Primary Examiner*—Harold J. Tudor

*Attorney, Agent, or Firm*—Robert F. Beers; William T. Ellis; Alan P. Klein

[57] ABSTRACT

An underwater sound generator composed of a ferrofluid contained within a toroidal container which has a rigid bottom and top and elastic cylindrical side walls. A coil of wire links the toroidal container and is adapted to be connected to a dc bias source to produce a biasing magnetic field, $H_{BIAS}$, which drives the magnetization of the ferrofluid well into saturation. Two oppositely wound coils of wire respectively link the inner side wall and the outer side wall and are adapted to be connected in series to an ac signal source to produce a time-varying magnetic field, $H_{AC}$, which modulates $H_{BIAS}$. The wires are equally spaced in the volume occupied by the ferrofluid. The gradient of $H_{AC}$ in the radial direction provides the time-varying force on the ferrofluid. The resulting ferrofluid motion in the radial direction is transmitted through the outer elastic side wall to supply acoustic motion to the surrounding water.

7 Claims, 2 Drawing Figures

FERROFLUID TRANSDUCER

BACKGROUND OF THE INVENTION

This invention relates generally to underwater sound generators, and more particularly to generators of low-frequency sound waves utilizing the fluid properties of ferrofluids.

Many years of research have been spent in a search for more efficient sonar equipment, but basically transducers for converting electrical energy into acoustic radiation in a fluid medium have been limited to magnetostrictive, piezoelectric, and moving-coil types. These sonar transducers have many shortcomings with respect to the production of low-frequency sound.

Within the size, weight, and mechanical constraints of the sonar application, any transducer intended for low-frequency sound generation will be small when compared with the acoustic wavelength in the medium. This condition implies a very low radiation resistance. The power radiated from a transducer whose dimensions are small with respect to the wavelength of the sound generated is determined by the radiation resistance acting on, and the volume velocity generated by, the radiating surface. Since the radiation resistance decreases with decreasing frequency, low-frequency acoustic sources must have a large volume velocity. Thus, the final compromise left to the transducer designer is a choice between increasing the transducer surface velocity or its radiating surface area. All magnetostrictive, piezoelectric, and moving-coil transducers suffer from the fact that they are surface velocity (or displacement)-limited. Therefore, to maintain a given power output, the surface area of the transducer must increase rapidly with decreasing frequency. However, if the surface area of the transducer is increased, the forces due to hydrostatic pressure will also increase, and a heavier device will result from the reuired pressure-compensation mechanism or required increase in the volume of structural materials. Another disadvantage is that the requirement for large volume velocities means that low-frequency sources are inherently large force devices and, as such, when utilizing magnetostrictive, piezoelectric, and moving-coil mechanisms, or other means of mechanical transformation, are generally not reliable over their operational lifetime.

In addition, the production of low-frequency sound is limited in prior-art devices in the following ways. Piezoelectric devices are brittle and break easily from shock or excessive displacements. Magnetostrictive materials have low displacement capabilities and efficiency except for certain rare earth-iron alloys which are extremely expensive and are not available in large quantities at any cost. Magnetostrictive and piezoelectric devices contain materials that are extremely heavy, even when submerged in water. Moving-coil devices require extensive pressure-compensation systems that limit operational depth and depth-cycling. Other mechanical devices such as hydraulic rams are very complicated and expensive. Transducers using controlled explosions are frequency-limited and non-reproducible.

SUMMARY OF THE INVENTION

Accordingly, it is an object of the present invention to improve the effectiveness and efficiency of underwater low-frequency sound generators.

Another object is to reduce the size and depth constraints of underwater low-frequency sound generators.

A further object is to provide a non-resonant underwater low-frequency sound generator which is frequency independent over large ranges to provide a broad bandwidth device.

The objects of the present invention are achieved by an underwater sound generator comprising a ferrofluid contained within a toroidal container which has a rigid bottom and top, and elastic cylindrical side walls. Means are associated with the toroidal container for producing in the circumferential direction both a biasing magnetic field and a time-varying magnetic field, the latter having a spatial gradient in the radial direction of the toroidal container. The magnetic field gradient provides the force on the ferrofluid. The ensuing motion of the ferrofluid is in the radial direction and is transmitted through the elastic side walls to supply acoustic motion to the surrounding medium.

The principal advantage of the inventive underwater sound generator is the fact that the acoustic energy is generated directly in a liquid (the ferrofluid) in contact with the means which produces the magnetic field. As a consequence, the device is not subject to several of the limitations inherent in the operation of other underwater sound sources.

Since the magnetic force is directly translated into motion of the liquid, relatively large displacements at the interface can be readily achieved. The latter is the major limitation in other underwater and sound generators, especially at low frequencies. Thus, the present invention can employ large surface displacements (velocities) in order to reach larger power output at low frequencies. Additionally, it is not limited in physical size, as a second factor in increasing the output. Since the magnetic field is created inside the liquid, increase in size of the device entails only an increase in volume of the liquid (the efficienty of the magnetic-field-producing means does not go down with increase in volume of the liquid).

Because the transducer material is a liquid, there is no limitation to the static pressure that can be sustained. Moreover, there is complete freedom from damage by shock or excessive displacement stress, an important advantage over the very brittle piezoelectric and magnetostrictive materials. The device can be operated in a free-flooded condition and, therefore, there is no need for cumbersome and heavy pressure-compensation materials. The specific gravity of the ferrofluid is only slightly larger than one (typically 1.20) and, therefore, buoyancy will provide the major part of the force needed to support and contain the device.

The device has no moving parts other than the cylindrical enclosure at the interface with the ambient medium, in favorable comparison with other types of low-frequency sound generators such as moving-coil and hydraulic ram sound generators. There is no problem involved in operating the device in a strictly harmonic way in contrast to controlled explosions used as a sound source.

Additional advantages and features wll become apparent as the subject invention becomes better understood by reference to the following detailed description when considered in conjunction with the accompanying drawings wherein:

DETAILED DESCRIPTION OF THE PREFERRED EMBODIMENT

Figure 1:
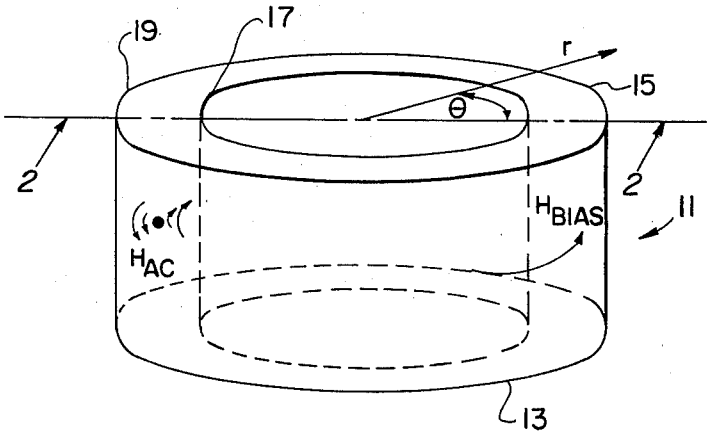
FIG. 1 is a perspective view of the device of the present invention with the electrical circuitry removed for purposes of clarity.
Figure 2:
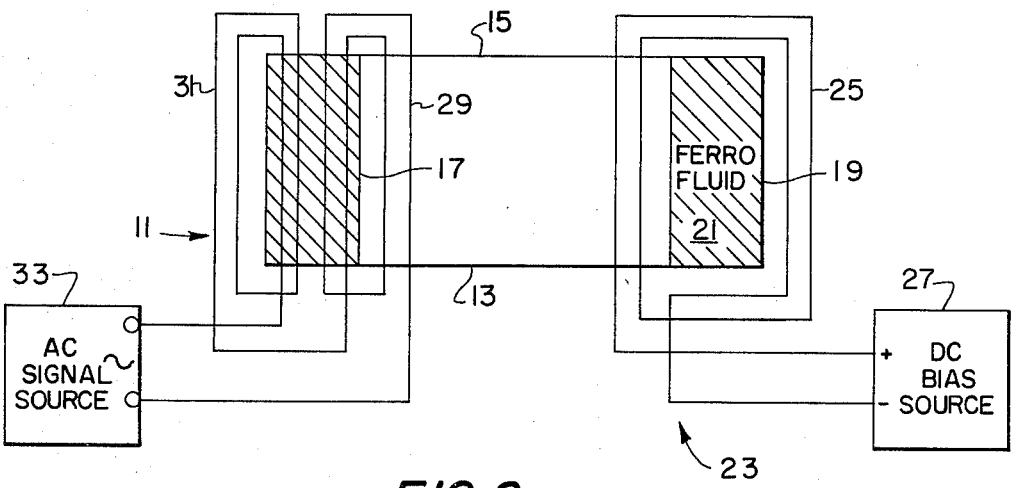
FIG. 2 is a section taken along section line 2—2 in FIG. 1 and showing the electrical circuitry.

Referring to FIG. 1, the underwater low frequency sound generator includes a toroidal container 11. The container has a rigid bottom 13 and a rigid top 15, both made of a suitable non-ferromagnetic material, and elastic inner and outer cylindrical side walls 17 and 19, both made of a suitable elastomer. The toroidal space bounded by the bottom and top of the container and the cylindrical side walls is filled with a ferrofluid 12. A ferrofluid is a colloidal suspension of subdomain ferromagnetic particles in a carrier fluid. Suitable hydrocarbon-based ferrofluids can be obtained from Ferrofluidics Corporation, Burlington, Mass., for example. Magnetic-field producing means 23 are associated with the container 11 for producing in the circumferential direction of the container a biasing magnetic field $H_{BIAS}$, and a time-varying magnetic field $H_{AC}$, the latter having a spatial gradient in the radial direction of the container. While the magnetic-field-producing means 23 may take a variety of forms, conveniently it may take the form illustrated in FIG. 2 of an electrically conductive coil of wire 25 linking the toroidal container and adapted to be connected to a dc bias source 27, and two oppositely wound, electrically conductive coils of wire 29 and 31, respectively, linking the inner side wall 17 and the outer side wall 19 and adapted to be connected in series to an ac signal source 33. The segments of coils 29 and 31 inside the toroidal container run parallel to the container's central axis and are equally spaced in the radial direction by suitable spacers (not shown) which may be, for example, disposed in planes perpendicular to the central axis so as not to inhibit the flow other than by increased friction.

In operation, the toroidal container 11 can be mounted on a drum, for example, and raised and lowered in and out of water. The dc bias source 27 is applied to coil 25, and current flowing in the coil produces a biasing magnetic field $H_{BIAS}$ which drives the magnetization of the ferrofluid 21 well into the saturation region so that operation will be linear with the ac drive field. Upon application of the ac signal source 33 to coils 29 and 31, current flowing in the coils produces a time-varying magnetic field $H_{AC}$ which modulates $H_{BIAS}$. The peak amplitude of $H_{AC}$ is chosen such that the magnetization of the ferrofluid does not vary perceptibly from its saturation value. It will be appreciated that both the biasing magnetic field $H_{BIAS}$ and the time-varying magnetic field $H_{AC}$ lie in the circumferential direction, but that $H_{AC}$ varies stepwise in the radial direction (as shown in FIG. 1) and it is this field gradient that provides the (time-varying) force on the ferrofluid 21 according to the relationship $$F=\mu_o M\vec{\nabla}H$$

where F is the force per unit volume, $\mu_o$ is the magnetic permeability of vacuum, M is the magnetization, and $\vec{\nabla}H$ is the gradient of the magnetic field. The ensuing ferrofluid motion is in the radial direction and is transmitted through the elastic outer side wall 19 to supply acoustic motion to the surrounding water.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An underwater, low-frequency sound generator comprising:

a toroidal container having a rigid bottom and a rigid top, and elastic inner and outer cylindrical side walls;

a ferrofluid filling the toroidal container; and magnetic-field-reducing means having elements inside the toroidal container and inside the ferrofluid itself for producing in the circumferential direction of the toroidal container both a biasing magnetic field and a time-varying magnetic field, the time-varying magnetic field providing a force causing the ferrofluid to move in the radial direction of the toroidal container, the motion of the ferrofluid being transmitted through the elastic outer side walls to supply acoustic motion to a surrounding medium.

2. The generator recited in claim 1 wherein the magnetic-field-producing means includes:

a coil of wire linking the toroidal container.

3. The generator recited in claim 1 wherein the magnetic-field-producing means includes:

a first coil of wire linking one side wall of the toroidal container; and a second coil of wire linking the other side wall of the toroidal container and connected in series with the first coil.

the first and second coils being wound in opposite sense.

4. The generator recited in claim 2 wherein the magnetic-field-producing means includes:

a dc bias source connected to the coil of wire linking the toroidal container.

5. The generator recited in claim 3 wherein the magnetic-field-producing means includes:

an ac signal source connected to the series-connected first and second coils of wire.

6. The generator recited in claim 1 wherein the ferrofluid includes:

a hydrocarbon carrier liquid, and subdomain ferromagnetic particles colloidally suspended in the carrier liquid.

7. The generator recited in claim 3 wherein:

segments of the first coil of wire and the second coil of wire inside the toroidal container run parallel to the central axis of the toroidal container, and are equally spaced in the radial direction of the toroidal container.

* * * * *